US007182661B2

(12) United States Patent
Sams et al.

(10) Patent No.: US 7,182,661 B2
(45) Date of Patent: Feb. 27, 2007

(54) DETACHABLE SURFBOARD FIN SYSTEM

(76) Inventors: David Bryan Sams, 1775 Wind River Rd., El Cajon, CA (US) 92019; Brandon Vincent Wilkie, P.O. Box 9193, San Diego, CA (US) 92169; Dennis Richard Murphy, P.O. Box 429, Julian, CA (US) 92036

( * ) Notice: Subject to any disclaimer, the term of this patent is extended or adjusted under 35 U.S.C. 154(b) by 0 days.

(21) Appl. No.: 11/064,979

(22) Filed: Feb. 24, 2005

(65) Prior Publication Data

US 2006/0189230 A1 Aug. 24, 2006

(51) Int. Cl.
*B63B 35/79* (2006.01)
*B63B 39/06* (2006.01)

(52) U.S. Cl. ..... 441/79; 114/140

(58) Field of Classification Search ..... 441/74, 441/79; 114/39.12, 39.15, 126–140, 143, 114/152

See application file for complete search history.

(56) References Cited

U.S. PATENT DOCUMENTS

| | | | | | |
|---|---|---|---|---|---|
| 3,659,300 | A * | 5/1972 | Johnson | 441/79 |
| 4,493,665 | A | 1/1985 | Liddle | |
| 5,007,868 | A | 4/1991 | Fry | |
| 5,032,096 | A | 7/1991 | Scott | |
| 5,328,397 | A | 7/1994 | Whitty | |
| 5,464,359 | A | 11/1995 | Whitty | |
| 5,503,581 | A | 4/1996 | McCullough | |
| 5,672,081 | A | 9/1997 | Whitty | |
| 5,934,963 | A | 8/1999 | Frizzell | |
| 5,975,974 | A * | 11/1999 | McCausland | 441/79 |
| 6,139,383 | A * | 10/2000 | Jolly et al. | 441/74 |
| 6,386,933 | B1 * | 5/2002 | Rewald et al. | 441/74 |
| 6,595,817 | B1 * | 7/2003 | Chang | 441/79 |
| 6,695,662 | B2 | 2/2004 | Kelley | |
| 6,752,674 | B2 | 6/2004 | Jolley | |
| 6,764,364 | B1 * | 7/2004 | Hickman et al. | 441/79 |
| 6,916,220 | B2 * | 7/2005 | Davey et al. | 441/79 |
| 6,991,504 | B1 * | 1/2006 | English et al. | 441/79 |
| 2003/0124924 | A1 | 7/2003 | McCausland | |
| 2004/0043681 | A1 | 3/2004 | Jolley | |

FOREIGN PATENT DOCUMENTS

| | | | |
|---|---|---|---|
| DE | 29603740 U1 * | 7/1996 | |

* cited by examiner

*Primary Examiner*—Ajay Vasudeva
(74) *Attorney, Agent, or Firm*—John L. Rogitz

(57) ABSTRACT

A system for attaching fins to surfboards that utilizes fixing elements embedded in the body of the board, the elements having slots that receive footings extending from the end of the fin. The footings are removably secured by a passive wedge clip fixing system, enabling fins to be removed for transport or upon damage by hand or simple tool. Screws can also be used for attachment.

7 Claims, 4 Drawing Sheets

DETACHABLE SURFBOARD FIN SYSTEM

FIELD OF THE INVENTION

The present invention relates generally to detachable surfboard fin systems.

BACKGROUND

Detachable surfboard fins have been provided for various reasons, including ease of finishing the surfboard before the otherwise interfering fins are installed, and replacing damaged fins without having to replace the entire surfboard. The present invention is directed to an improved, lightweight detachable surfboard fin system that provides secure and easy engagement of fins to surfboards.

SUMMARY OF THE INVENTION

A surfboard fin insert includes a single unitary insert body defining first and second footing receptacles. The footing receptacles are longitudinally spaced from each other when the body is engaged with the surfboard.

In some embodiments the insert body includes a fin surface defining a gently curved contour that is substantially devoid of sharp edges. The insert body may be formed with plural engagement ridges circumscribing the insert body and being generally parallel to a fin surface of the insert body. The ridges facilitate engagements of the insert with a surfboard.

Each footing receptacle may be generally wedge-shaped. In some implementations, each footing receptacle may be formed with a notch in a side wall of the receptacle, for snapping engagement with a fin as more fully disclosed below. Also or in the alternative, each footing receptacle can be formed with a channel configured for threadably receiving a threaded fastener, to threadably engage a fin as discussed more fully below. When the receptacle has a channel, the channel may extend at an oblique angle relative to the surface of the insert.

In another aspect, a surfboard fin includes first and second longitudinally-spaced footings extending down from the fin member of the fin. Each footing is configured for engaging a complementarily-shaped receptacle in a surfboard insert to hold the fin into the insert.

In some implementations each footing may be integrally formed with a clip that is movable in a lateral dimension relative to the fin member. The clip is biased to an outward configuration and is movable to an inward configuration to facilitate snapping engagement of the clip with a notch in a respective receptacle of the insert. In other implementations each footing may be formed with a fastener channel extending from a fin surface of the footing through the footing, with the fin member being contiguous to and extending above the fin surface. A threaded fastener is disposed in the fastener channel and extends into the channel of the insert receptacle to hold the fin onto the insert.

In still another aspect, a surfboard system includes a board member on which a surfer can stand, and one or more unitary insert bodies disposed on the board member. Each insert body defines first and second footing receptacles that are longitudinally spaced from each other relative to the board member. A surfboard fin having a fin member and first and second longitudinally-spaced footings extending down from the fin member can be engaged with the insert body. Specifically, each footing engages a respective receptacle in the insert body to hold the fin into the insert and thus to engage the fin with the board member.

The details of the present invention, both as to its structure and operation, can best be understood in reference to the accompanying drawings, in which like reference numerals refer to like parts, and in which:

DETAILED DESCRIPTION OF THE PREFERRED EMBODIMENT

Figure 1:
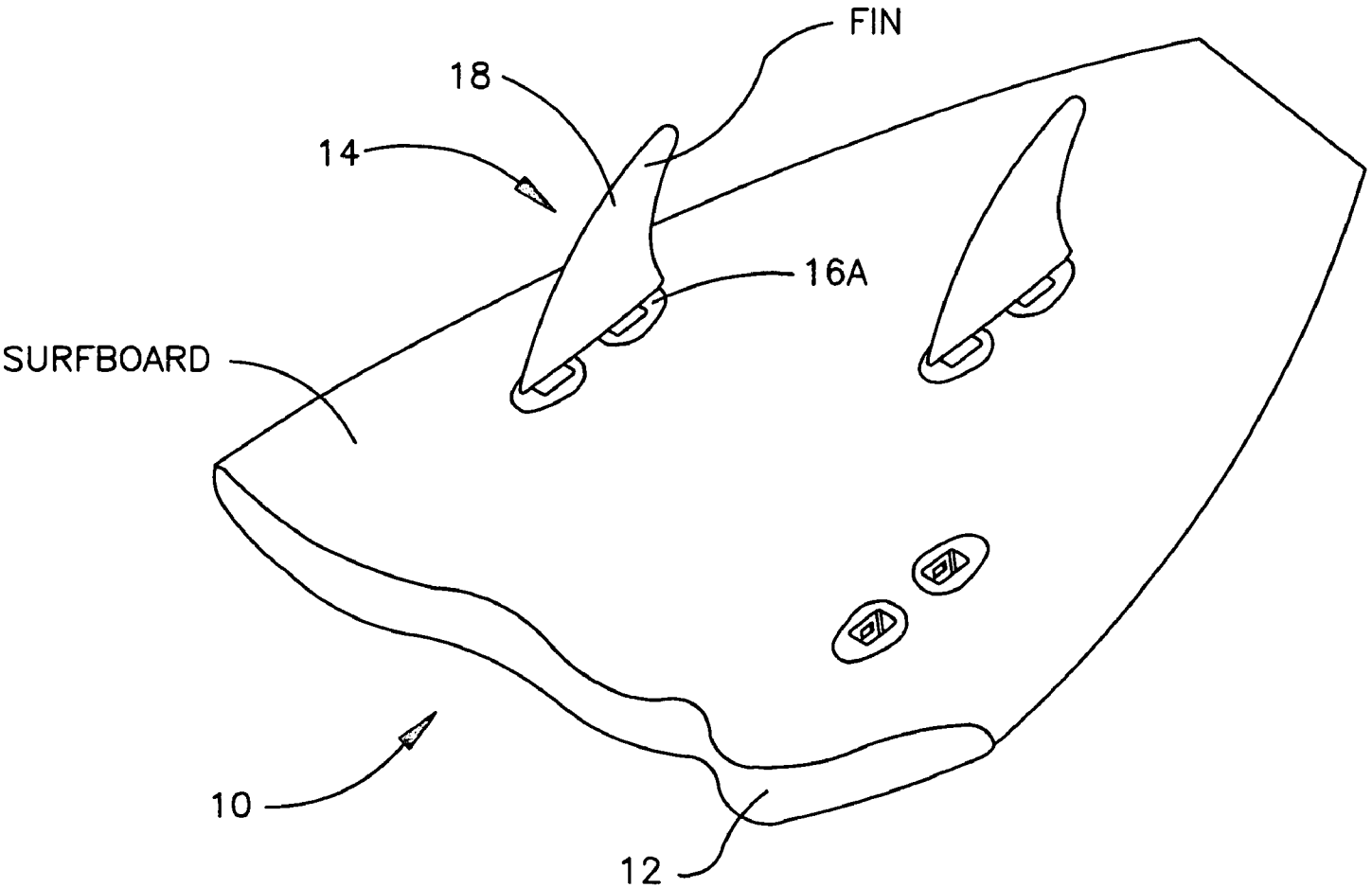
FIG. 1 is a perspective view of the surfboard with insert and detachable fin, with portions of the surfboard broken away.

Referring initially to FIG. 1, a surfboard system is shown, generally designated 10, that includes a board member 12 on which a surfer can stand and one or more surfboard fins 14 projecting from the bottom surface of the board member 12. FIG. 1 shows two fins for illustration and an insert without a fin attached.

Specifically, as shown in FIG. 1 each fin 14 is held onto the board member 12 by a respective unitary insert body 16A that is tightly received within a complementarily-shaped hole in the board member 12. The hole in the board member 12 may be made by a tapered bit. As set forth further below, the insert body 16A, which is flush with the bottom surface of the surfboard member 12 as shown, defines at least two footing receptacles that are longitudinally spaced from each other relative to the board member 12, and respective longitudinally-spaced footings are on the fin 14 and extend down from the fin member 18 of the fin 14 to engage a respective receptacle in the insert body 16A to hold the fin 14 into the insert 16A and thus to engage the fin 14 with the board member 12.

In non-limiting implementations the board member 12 may be fiberglass and the insert body 16A may be polycarbonate, while the fin 14 may be injection molded plastic or fiberglass. The insert body 16A may be affixed to the board member 12 by means of polyester resin or other adhesive chosen for compatibility with the materials used. The holes in the board 12 into which the insert body 16A fits may be drilled using, e.g., a hand drill in conjunction with suitable jigs and templates, to match the contour of the insert body 16A. As shown, the insert body 16A presents an uninterrupted surface that is flush with that of the board 12, and may further be sanded and finished along with the board surface, so that the final finishing steps of board manufacture may be carried out without the fin 14 in place to obstruct the operator or the equipment. This reduces costs and enables better finishes to be obtained, and the hydrodynamic deficiencies of the prior art arrangements avoided.

Figure 2:
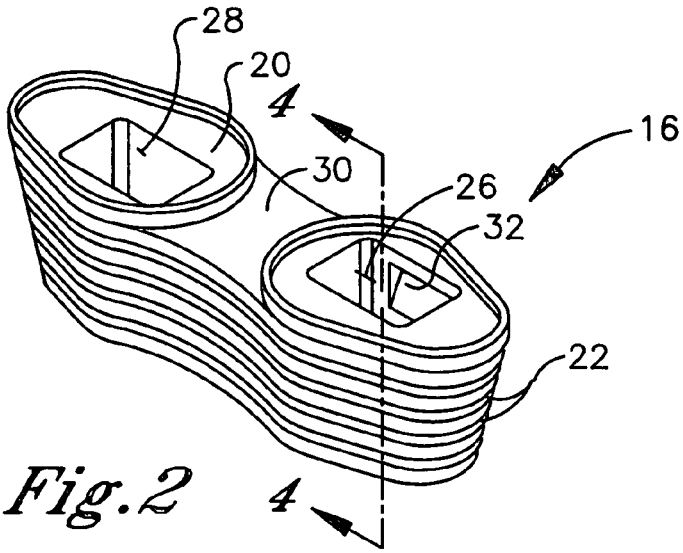
FIG. 2 is a perspective view of the insert from the board surface side.
Figure 3:
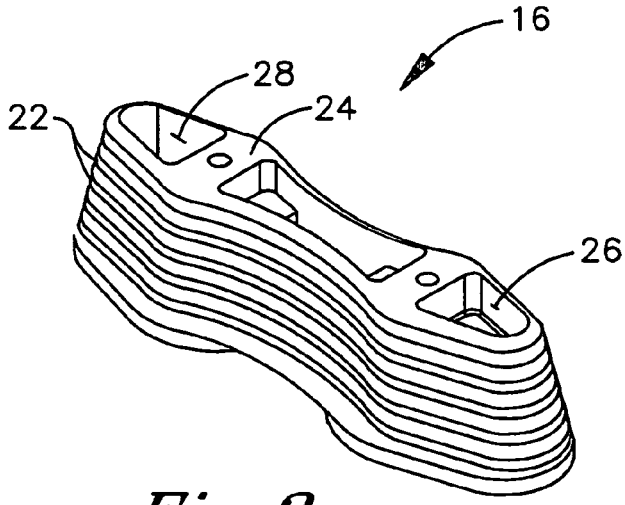
FIG. 3 is a perspective view of the insert from the side opposite to the board surface side.
Figure 4:
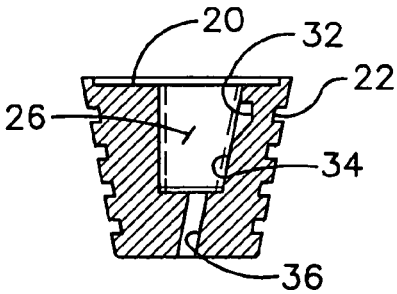
FIG. 4 is a cross-sectional view of the insert as taken along the line 4—4 in FIG. 2.

Details of an insert body 16 can be seen in FIGS. 2–4. The insert body 16 shown in FIGS. 2–4 is in all essential respects identical to the insert body 16A shown in FIGS. 1 and 6–9 with the below-noted exceptions. As shown in FIGS. 2–4, the insert body 16 is a single unitary body that is generally elongated in the dimension of board elongation. The insert body 16 includes a fin surface 20 that defines a gently curved contour which is substantially devoid of sharp edges. The small lip shown in FIG. 2 that circumscribes and extends above the fin surface 20 may be sanded off during manufacture, or may be maintained if desired and the fin surface 20 raised by means of a layer of filler material so that the insert body 16 is flush with the bottom surface of the board member 12. In the non-limiting embodiment shown, the insert body 16 is shaped somewhat like a person's shoe.

As best shown in FIGS. 2 and 3, the insert body 16 is formed with plural engagement ridges 22 that circumscribe the insert body 16. The ridges 22 are parallel to the fin surface 20 of the insert body 16. Further, as shown the insert body 16 itself is tapered radially inwardly from the fin surface 20 to the opposite surface 24 which is embedded in the board member 12 when the insert body 16 is properly installed. It is to be understood that the insert body 16 configuration shown facilitates engagements of the insert body 16 with the board member 12. In particular, the configuration shown distributes energy through a relatively large area equally and evenly so that the insert body 16 need not be attached to the top surface (sometimes referred to as the "top deck") of the board member 12. Moreover, owing to the use of large surface area with no corners and the tapered configuration discussed above, the insert body 16/board member 12 combination is rendered relatively resistant to stress cracks and other stress-related failures.

FIG. 2 shows that the insert body 16 defines at least first and second footing receptacles 26, 28. The footing receptacles 26, 28 are longitudinally spaced from each other when the insert body 16 is engaged with the board member 12, but the insert body 16 is rendered structurally continuous end-to-end by means of a central bridge 30. As shown in FIG. 3, the central bridge 30 may not necessarily extend the depth of the insert body 16 but instead may be a relatively thin structure disposed on the insert body 16 near the fin surface 20, rendering the insert body 16 lightweight yet strong. In this way, a strong system 10 is established by means of the length and bridged-base support of the insert body 16.

As shown in FIGS. 2 and 4 and taking the footing receptacle 26 as an example, each footing receptacle 26 is generally wedge-shaped in transverse cross-section. In the specific non-limiting embodiment shown in FIG. 4, the footing receptacle 26 may be shaped like a trapezoid.

In the embodiment shown in FIGS. 2–4, for purposes to be shortly disclosed each footing receptacle 26, 28 can be formed with a respective notch 32 in a side wall 34 of the receptacle, i.e., one of the walls that extend from front to rear relative to the dimension defined by the surfboard. Moreover, in some implementations each footing receptacle 26, 28 may be formed with a respective internally threaded channel 36 that is configured for threadably receiving a threaded fastener in accordance with disclosure below. The channel 36 can extend at an oblique angle relative to the fin surface 20 as shown. In this way, either one of the below-disclosed "snapping engagement" and "threaded fastener" fins can be accepted into the insert body 16.

It is to be understood that while FIG. 2 illustrates that the notch of one receptacle may be opposed, relative to the centerline of the insert body 16, from the notch of the other receptacle, and indeed that the receptacles themselves may be opposed to each other relative to the centerline, both receptacles and/or notches may be on the same side of the centerline. Indeed, to illustrate this, FIGS. 6–9 below show a fin that can be engaged with an insert 16A of the present invention in which both of the below-described footings are on the same side of the fin centerline and, hence, in which both notches of the insert correspondingly would be on the same side of the insert centerline. The skilled artisan will appreciate that when the insert notches are on opposite sides of the insert centerline as shown in FIGS. 2–4, then the below-described fin footings would also be on opposite sides of the fin centerline from each other.

Figure 5:
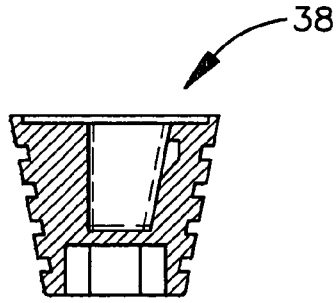
FIG. 5 is a cross-sectional view of an alternate insert as would be seen along the line 4—4 in FIG. 2.
Figure 6:
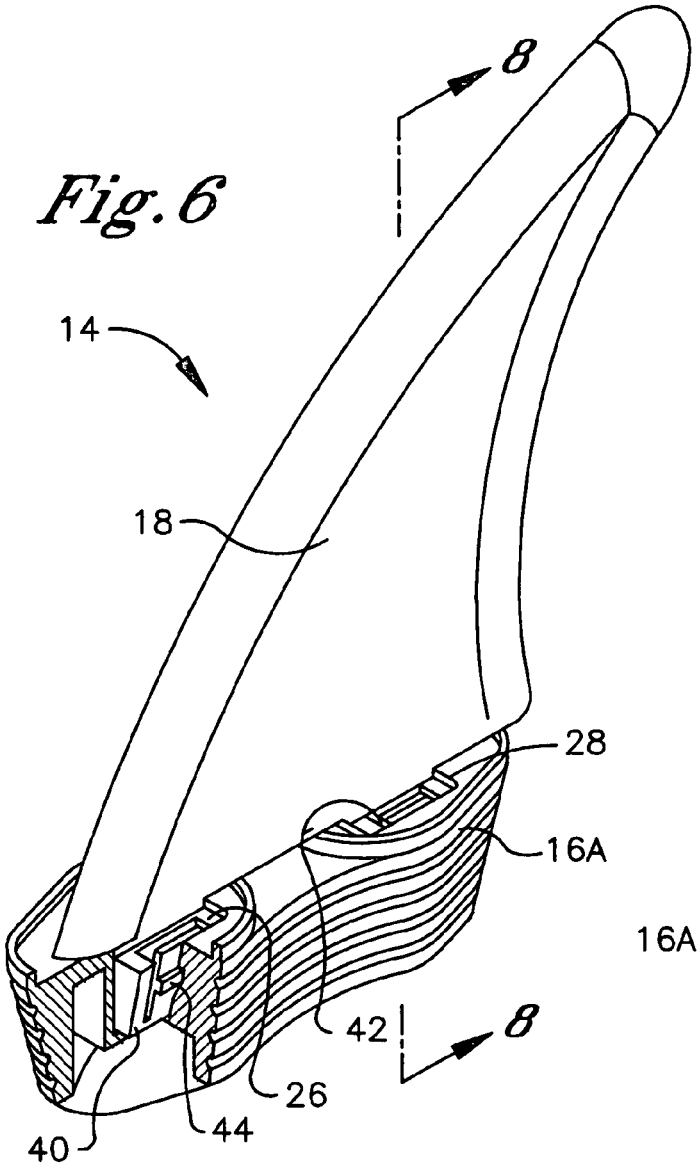
FIG. 6 is a perspective view of a clip embodiment of the fin in engagement with the insert, with portions of the insert broken away for clarity.
Figure 8:
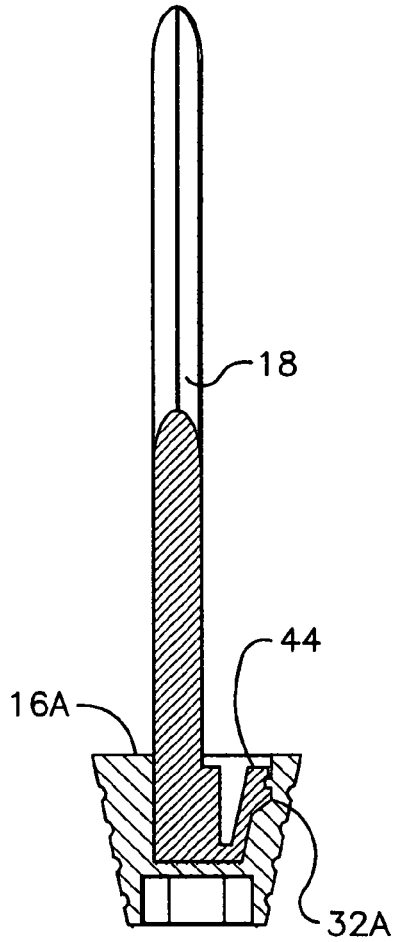
FIG. 8 is a cross-sectional view of the fin with insert as taken along the line 8—8 in FIG. 6.
Figure 7:
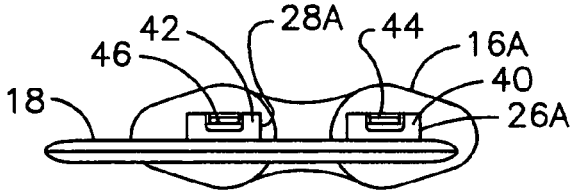
FIG. 7 is a top plan view of the fin and insert shown in FIG. 6.
Figure 9:
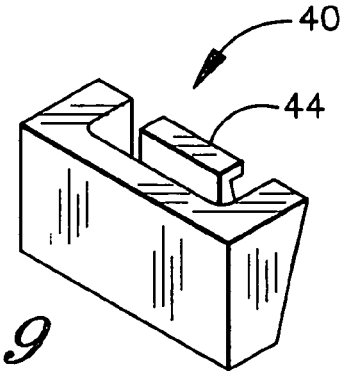
FIG. 9 is a perspective view of one of the footings of the fin shown in FIG. 6.

FIG. 5 shows an alternate insert body 38 that is in all essential respects identical to the insert body 16 of FIG. 2, except that it need not have a channel, but instead can have a hollow bottom section such that it defines a transverse cross section that is generally H-shaped as shown.

FIGS. 6–9 show details of a "snapping engagement" fin 14. The fin 14 has a fin member 18 which performs the function of a surfboard fin when the board is in the water. The fin member 18 is connected, preferably integrally connected during molding, with at least first and second longitudinally-spaced footings 40, 42 that extend down from the fin member 18 into respective receptacles 26A, 28A of an insert body 16A, with the "A" designation indicating that the insert body 16A shown in FIGS. 6–9 is essentially identical to the insert body 16 shown in FIGS. 2–4, except that the receptacles and corresponding notches are on the same side of the centerline of the insert body 16A shown in FIGS. 6–9 to match the particular non-limiting fin 14 shown in these figures. Each footing 40, 42 is complementarily-shaped to its respective receptacle 26A, 28A, so that when the receptacles 26A, 28A are wedge-shaped, so are the footings 40, 42.

In the embodiment shown in FIGS. 6–9, each footing 40, 42 is integrally formed with a respective clip 44, 46. Each clip 44, 46 can be moved in a lateral dimension relative to the fin. Each clip 44, 46 preferably is biased to an outward configuration and is movable to an inward configuration.

With this structure, it may now be appreciated that to engage the fin member 14 with the insert body 16A, the footings 40, 42 on the fin are advanced into their respective receptacles 26A, 28A in the insert. As the footings 40, 42 are advanced into their receptacles 26A, 28A, the clips 44, 46 ride against the walls of the receptacles and as a consequence are deformed inwardly. Once a clip, e.g., the clip 44, is clear to engage the notch 32A (FIG. 8) of the receptacle 26A, the clip 44 snaps outwardly under the influence of its material bias into the notch 32A to snappingly engage the fin with the insert.

To disengage the fin from the insert, the clips 44, 46 may be accessed by simple tool such as a flathead screwdriver and deformed to the inward configuration, and then the fin retracted from the insert.

Figure 10:
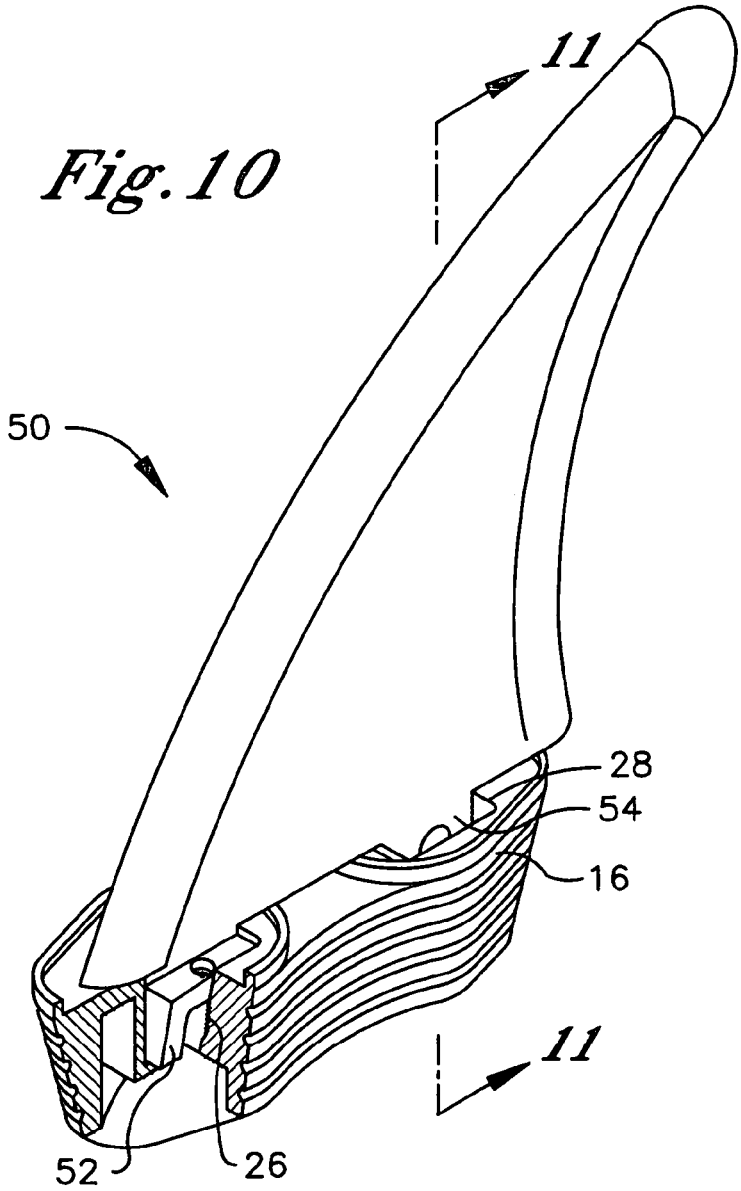
FIG. 10 is a perspective view of a threaded fastener embodiment of the fin in engagement with the insert, with portions of the insert broken away for clarity.
Figure 12:
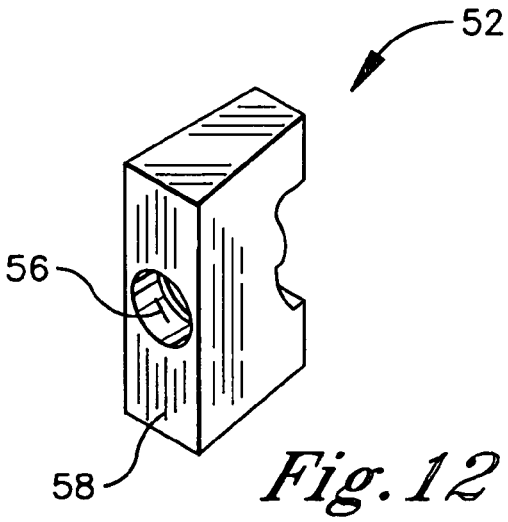
FIG. 12 is a perspective view of one of the footings of the fin shown in FIG. 10.
Figure 11:
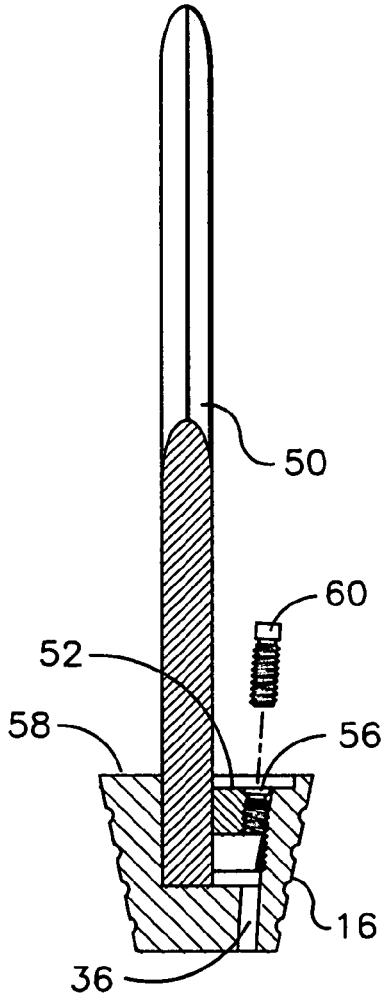
FIG. 11 is a cross-sectional view of the fin with insert as taken along the line 11—11 in FIG. 10, showing a threaded fastener in an exploded relationship with the fin.

FIGS. 10–12 show an alternate fin 50 having engagements on opposite sides of the fin centerline and, hence, suitable for use with the insert body 16 shown in FIGS. 2–4, since, it will be recalled, the receptacles of that insert body 16 are formed on opposite sides of the insert centerline. The alternate fin 50, like the fin 14 discussed above, may have at least two longitudinally-spaced wedge-shaped footings 52, 54, except that instead of snapping into respective wedge-shaped receptacles 26, 28 of the insert body 16, the footings are screwed in.

More specifically, taking the footing 52 as an example, the footing 52 is formed with a fastener channel 56 that extends from the fin surface 58 of the footing 52 down through the footing 52. The fastener channel 56 may be internally threaded if desired and may establish an oblique angle with the fin surface 58 as shown. When the footing 52 is disposed in the receptacle 26 of the insert body 16, the fastener channel 56 of the footing 52 is coaxial with the channel 36 of the receptacle 26. Accordingly, a threaded fastener 60 can disposed through the fastener channel 56 of the footing 52 and into threadable engagement with the channel 36 of the receptacle 26 of the insert body 16, to fasten the fin 14 to the insert 16 and, hence, to the surfboard.

While the particular DETACHABLE SURFBOARD FIN SYSTEM as herein shown and described in detail is fully capable of attaining the above-described objects of the invention, it is to be understood that it is the presently preferred embodiment of the present invention and is thus representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more". It is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. Absent express definitions herein, claim terms are to be given all ordinary and accustomed meanings that are not irreconcilable with the present specification and file history.

What is claimed is:

1. A surfboard fin, comprising:

at least first and second longitudinally-spaced footings extending down from a fin member of the fin, each footing being configured for engaging a complementarily-shaped receptacle in a surfboard insert to hold the fin into the insert, wherein each footing is integrally formed with a clip pivotably movable relative to the fin member, the clip being biased to an outward configuration and movable to an inward configuration to facilitate snapping engagement of the clip with a notch in a respective receptacle of the insert, wherein each footing is formed with a fastener channel extending from a fin surface of the footing, the fin member being contiguous to and extending above the fin surface.

2. The fin of claim 1, further comprising a threaded fastener disposed in the fastener channel.

3. The fin of claim 1, wherein the fastener channel establishes an oblique angle with the fin surface.

4. A surfboard system, comprising:

a board member on which a surfer can stand;

at least one unitary insert body disposed on the board member and defining first and second footing receptacles, the footing receptacles being longitudinally spaced from each other relative to the board member; and a surfboard fin having a fin member and first and second longitudinally-spaced footings extending down from the fin member, each footing engaging a respective footing receptacle in the insert body to hold the fin into the insert thus to engage the fin with the board member, wherein each footing receptacle is generally wedge-shaped and each footing is complementarily-shaped to a respective footing receptacle, wherein the insert body includes a fin surface defining gently curved contour substantially devoid of sharp edges.

5. A surfboard system, comprising;

a board member on which a surfer can stand;

at least one unitary insert body disposed on the board member and defining first and second footing receptacles, the footing receptacles being longitudinally spaced from each other relative to the board member; and a surfboard fin having a fin member and first and second longitudinally-spaced footings extending down from the fin member, each footing engaging a respective footing receptacle in the insert body to hold the fin into the insert thus to engage the fin with the board member, wherein each footing receptacle is formed with a notch in a wall of the footing receptacle, the wall extending from front to rear relative to the dimension defined by the footing receptacle, each footing of the fin being integrally formed with a clip pivotable relative to the fin member, the clip being biased to an outward configuration and movable to an inward configuration to facilitate snapping engagement of the clip with a respective notch in the insert.

6. A surfboard system, comprising:

a board member on which a surfer can stand;

at least one unitary insert body disposed on the board member and defining first and second footing receptacles, the footing receptacles being longitudinally spaced from each other relative to the board member; and a surfboard fin having fin member and first and second longitudinally-spaced footings extending down from the fin member, each footing engaging a respective footing receptacle in the insert body to hold the fin into the insert thus to engage the fin with the board member, wherein each footing receptacle is generally wedge-shaped and each footing is complementarily-shaped to a respective footing receptacle, wherein each footing receptacle of the insert is formed with a channel configured for threadably receiving a threaded fastener and each footing of the fin is formed with a fastener channel, and the system comprises:

a respective threaded fastener disposed in a respective fastener channel of the fin and threadably engaging a respective channel of the insert.

7. The system of claim 6, wherein the insert body includes a fin surface, and the channels of the insert and the fastener channels of the fin each extend at an oblique angle relative to the fin surface.

* * * * *